US007066549B2

(12) United States Patent
Dennon et al.

(10) Patent No.: US 7,066,549 B2
(45) Date of Patent: Jun. 27, 2006

(54) ADJUSTABLE QUICK RELEASE SEATBACK SYSTEM PARTICULARLY FOR USE WITH WHEELCHAIRS

(75) Inventors: Murray Dennon, Mercer Island, WA (US); John S. Lincoln, Vashon Island, WA (US)

(73) Assignee: Cascade Designs, Inc., Seattle, WA (US)

( * ) Notice: Subject to any disclaimer, the term of this patent is extended or adjusted under 35 U.S.C. 154(b) by 89 days.

(21) Appl. No.: 10/428,331

(22) Filed: May 1, 2003

(65) Prior Publication Data

US 2004/0066081 A1 Apr. 8, 2004

Related U.S. Application Data

(63) Continuation-in-part of application No. PCT/US01/45850, filed on Nov. 1, 2001.

(60) Provisional application No. 60/245,074, filed on Nov. 1, 2000.

(51) Int. Cl.
*A47C 7/42* (2006.01)

(52) U.S. Cl. ..... 297/440.2; 297/378.13; 297/354.12

(58) Field of Classification Search ..... 297/354.12, 297/378.13, 440.2, DIG. 4
See application file for complete search history.

(56) References Cited

U.S. PATENT DOCUMENTS

| | | | | |
|---|---|---|---|---|
| 3,410,600 | A * | 11/1968 | Thorpe | 297/378.13 |
| 4,765,682 | A * | 8/1988 | Satoh | 297/378.13 |
| 5,127,709 | A * | 7/1992 | Rubinstein et al. | 297/440.2 |
| 5,282,286 | A * | 2/1994 | MacLeish | 297/469 |
| 5,364,162 | A | 11/1994 | Bar et al. | |
| 5,556,168 | A * | 9/1996 | Dinsmoor et al. | 297/440.2 |
| 5,647,637 | A | 7/1997 | Jay et al. | |
| 5,662,369 | A * | 9/1997 | Tsuge | 297/378.13 |
| 5,842,264 | A | 12/1998 | Roossien et al. | |
| 5,848,824 | A * | 12/1998 | Mocur | 297/440.2 |
| 6,164,724 | A | 12/2000 | Greaves | |
| 6,257,664 | B1 * | 7/2001 | Chew et al. | 297/354.12 |
| 6,257,665 | B1 | 7/2001 | Nagamitsu et al. | |
| 6,688,693 | B1 * | 2/2004 | Christofferson et al. | 297/354.12 |

FOREIGN PATENT DOCUMENTS

WO WO 02/28339 A3 4/2002

* cited by examiner

*Primary Examiner*—Peter R. Brown
(74) *Attorney, Agent, or Firm*—Graybeal Jackson Haley, LLP

(57) ABSTRACT

A wheelchair seatback assembly suitable for detachable mounting to the back-supporting posts of a wheelchair. The back assembly includes a relatively rigid shell member carrying post-engaging pins and a plurality of mounting clips attachable to wheelchair posts. At least selected ones of the mounting clips are further formed to releasably engage the post-engaging pins. The mounting units are also formed for single-handed automatic unlocking and release of the pair of hooks from the mounting units and posts upon rotation of the shell member forwardly over the wheelchair seat by an amount in excess of any displacement occurring during normal use of the wheelchair.

30 Claims, 6 Drawing Sheets

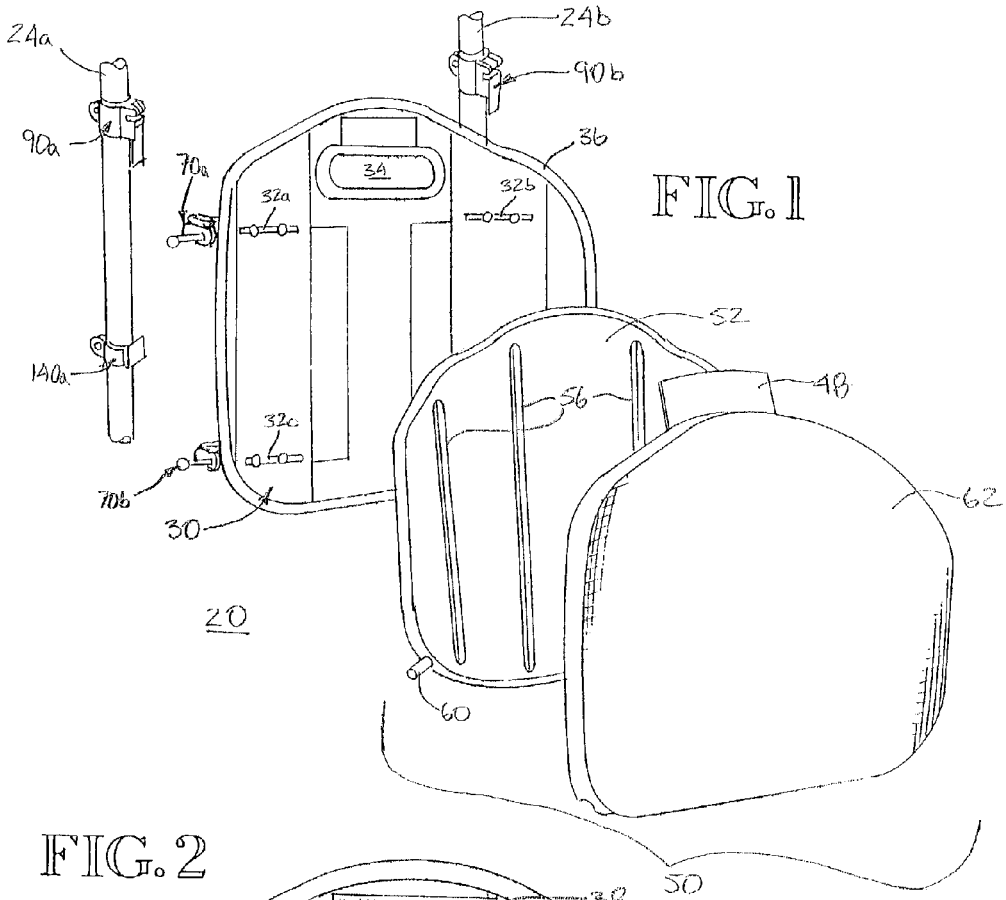
FIG. 1
FIG. 2
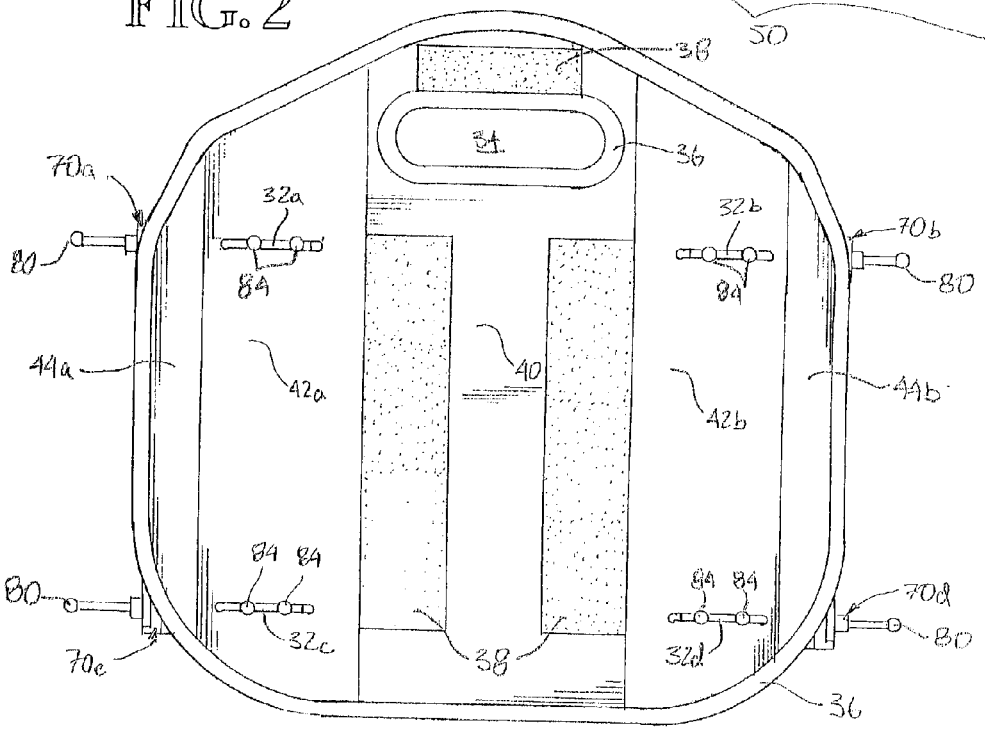

FIG. 3
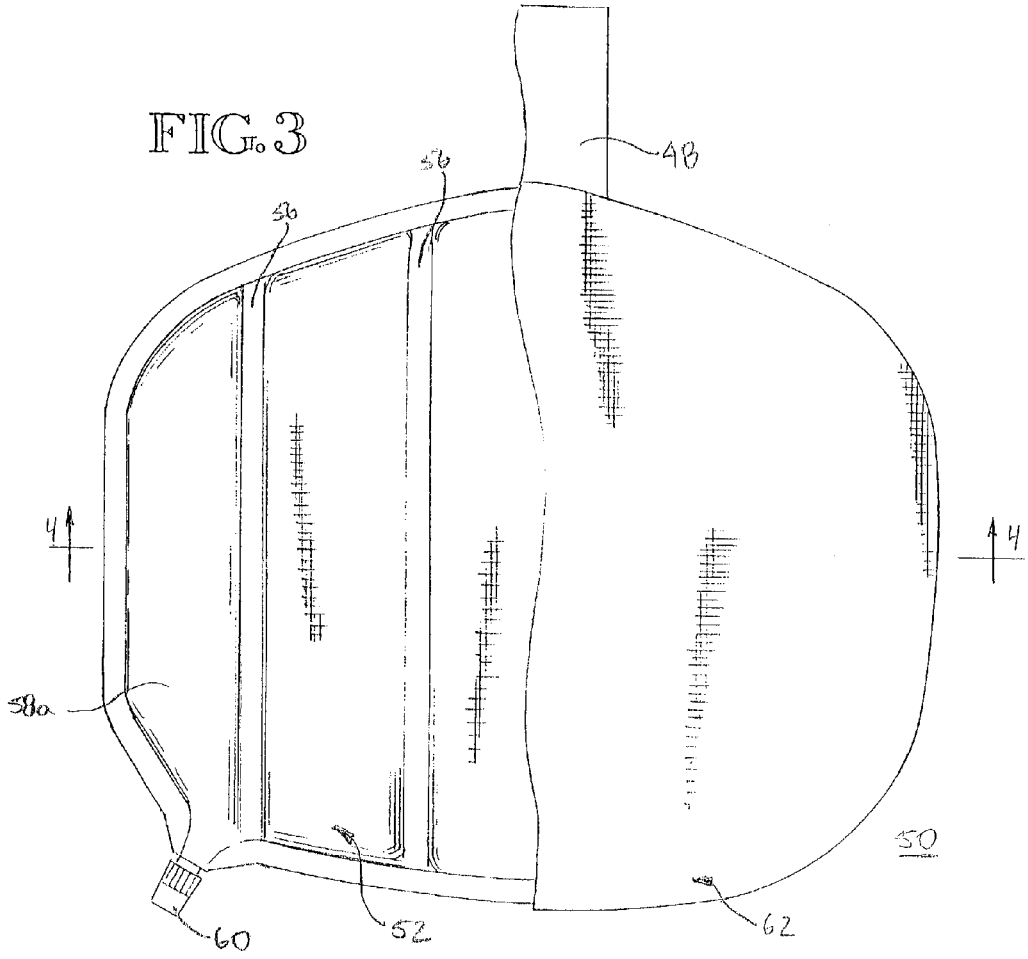
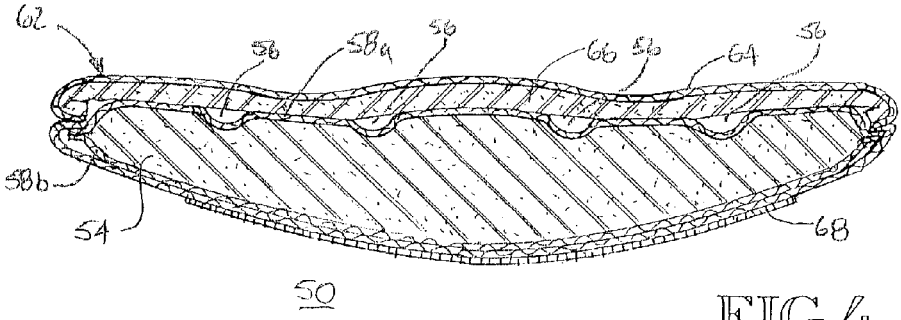
FIG. 4

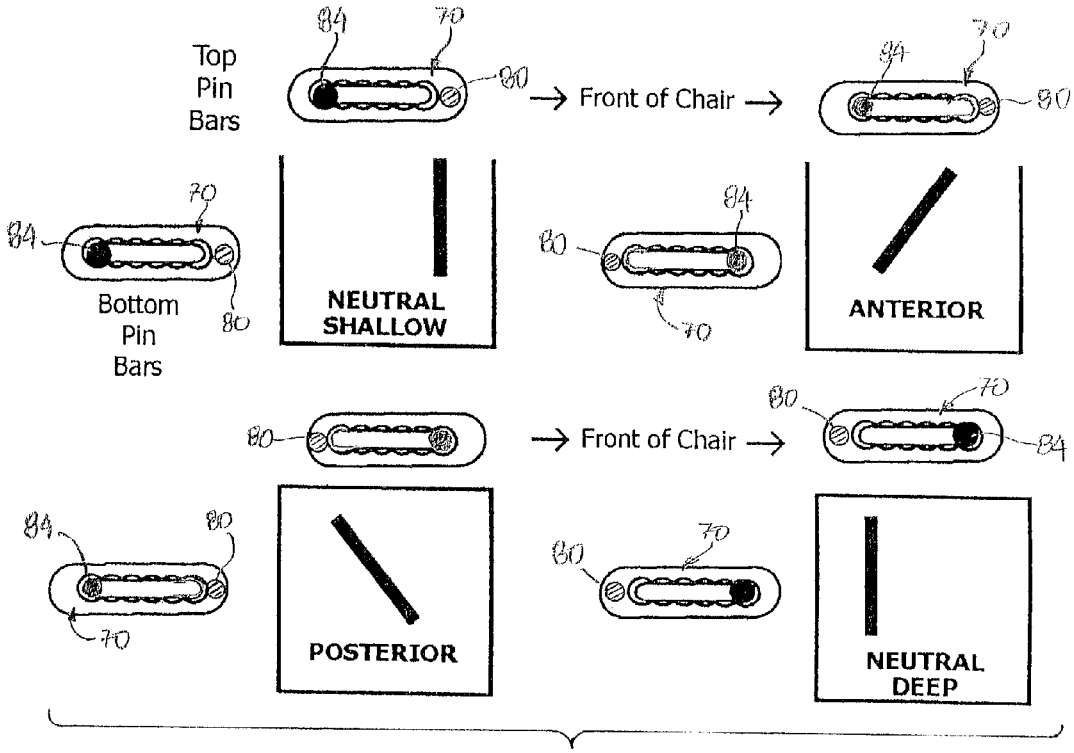
FIG. 8
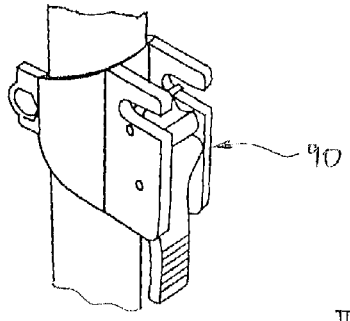
FIG. 9
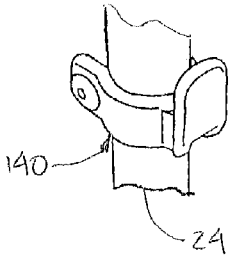

FIG. 10
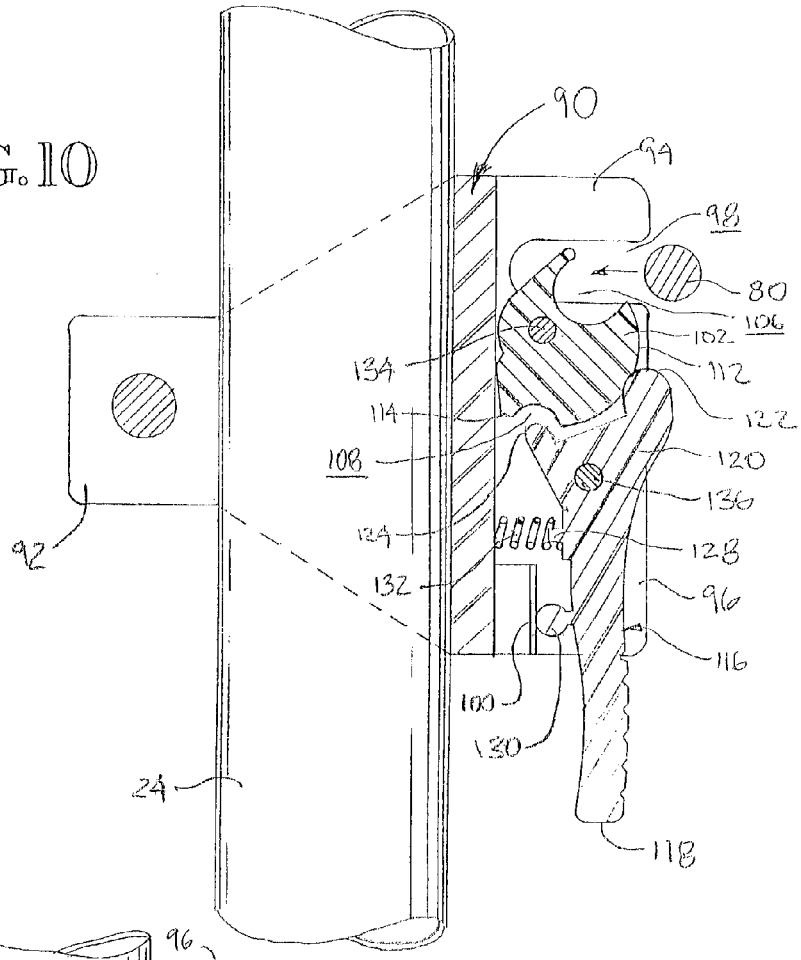
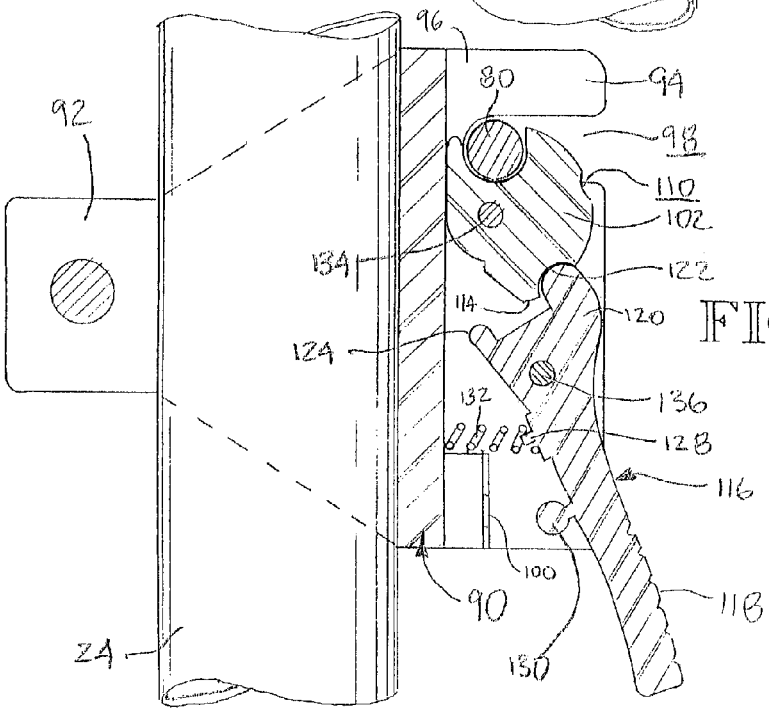
FIG. 11

ADJUSTABLE QUICK RELEASE SEATBACK SYSTEM PARTICULARLY FOR USE WITH WHEELCHAIRS

This application is a continuation-in-part of PCT/US01/45850 filed Nov. 1, 2001 which claims benefit from U.S. provisional application Ser. No. 60/245,074 filed Nov. 1, 2000.

FIELD OF THE INVENTION

The present invention relates to the fields of furnishings and cushions, and more particularly to the field of wheelchair seatbacks. The invention is particularly suited for use with collapsible wheelchairs wherein a rigid, yet easily removable seatback is desired.

BACKGROUND OF THE INVENTION

Many of the problems faced by wheelchair users are related to the positioning and ultimate posture of the seated user. Typical problems include progressive spinal deformations such as kyphosis, lordosis, and scoliosis. Poor posture and permanent spinal deformations can cause reduced function and mobility, fatigue, impaired respiration, impaired swallowing, and increased risk of sacreal, coccygeal, lumbar or thoracic tissue break down. Thus, it is very important for any wheelchair seatback system to provide for proper back angle adjustment and support because different users usually require a specifically tailored seat to back angle in order to optimize their own function and mobility.

An advantage of using rigid seatbacks as opposed to sling-type arrangements is that posture control is greatly enhanced. Thus, rigid seatbacks are generally preferred over sling-type seatbacks so that the user may achieve the most appropriate support for a given condition. Moreover, a rigid arrangement increases structural rigidity to the wheelchair, and provides a more effective force transmission element for active wheelchair users.

Another important object to any wheelchair seatback system not using a sling-type arrangement is that it be convenient to remove and install. Disabled users must frequently remove and install the wheelchair back and wheelchair cushion from the wheelchair in order to collapse the wheelchair for storage or transportation, and put it back together for use. This procedure, when performed independently by a user with impaired mobility, is often accomplished from the driver's side seat or passenger's side seat of an automobile. To collapse the wheelchair, the user must first reach out and remove the back. The wheelchair may then be collapsed and be placed in the desired location, such as the rear seat of the automobile. To re-assemble the wheelchair, the user will typically pull the collapsed chair from the rear seat of the car and unfold the chair at ground level next to the car. Once the frame is unfolded, the user must then reach out and attach the seatback onto the wheelchair. Both disassembly and assembly are usually accomplished mostly with one hand because the disabled user must maintain support with the other hand, normally by grasping the steering wheel.

The maneuver of reaching out from the car to attach or detach the wheelchair back can be difficult, particularly since most wheelchair users, especially quadriplegics, have impaired upper extremity function and compromised dexterity in their hands and, therefore, may experience great difficulties in manipulating heavy objects in a precise manner. Because of this, the degree of manipulation required of a particular wheelchair component, such as a seatback, will often determine whether or not it can even be used by a disabled individual.

Besides having the seatback system as simple and easy as possible to attach and detach, it is also beneficial to have it attachable and detachable by a user from in the front of the wheelchair. This is because a user having just transferred out of the wheelchair, or about to transfer into the wheelchair, will usually be positioned generally in front of the wheelchair. Accordingly, a simplified seatback mounting mechanism that enables the wheelchair user to swiftly attach or detach the back system to or from the wheelchair, especially from a position in front of the wheelchair, would greatly expand the usability of the seatback system to the disabled population.

Another problem facing wheelchair back systems has been the variability of each type of commercially available wheelchair. In particular, the vertical upright posts or canes often differ in configuration from one wheelchair to another. The nominal diameter of the posts may vary from ½" to 1¼". The center to center distances of the posts may vary ±½" despite the typical designation by the wheelchair manufacturer that the chair is a nominal width to the nearest inch (i.e., an 18" wide wheelchair may actually measure 17.6" wide). These vertical posts may also not be parallel and indeed are designed to taper outward from bottom to top. All of these variations along with the metric size requirements offered by foreign wheelchair manufacturers demand either a custom made seatback system or a custom fit off-the-shelf seatback system with considerable adjustability through the available size ranges of wheelchairs.

Many prior art systems have dealt with the post (cane) dimension variability by maintaining a maximum and minimum width capability, which inherently results in a loose fit at the narrow end of the width limit. The loose fit may cause the seatback to shift from side to side or, in some cases, the outer margins of the seatback system overhang the width of the wheelchair and interfere with armrests and other peripheral features on the wheelchair.

Numerous attempts have been made to replace the conventional wheelchair upholstery sling back with a comfortable, sturdy, adjustable, supportive, pressure relieving, easy to use seatback system. However, prior art systems have generally failed to provide a suitable degree of adjustability, without loss of seat depth, in conjunction with a system that is easily attached or detached from the wheelchair and that is also capable of seatback angle adjustment with no loss of seat depth while the user is occupying the wheelchair. Available systems known to date have also failed to incorporate both the capability to adjust the seatback angle while the user is in the wheelchair and a removably attachable mounting system that does not alter the adjusted seatback angle each time the back system is removed from the wheelchair. Furthermore, the prior art seatback systems have generally failed to address the related problems of maintaining pelvic alignment while the back system is adjusted to the optimum seat to seatback angle.

SUMMARY OF THE INVENTION

The invention is directed to an adjustable and removable seatback system for use with any chair having four seatback mounting locations, but particularly with respect to such a seatback for use with a wheelchair having two vertical posts or canes. The present invention permits convenient, single-handed attachment or detachment of the seatback to and from a wheelchair without pre-release or actuation of latches or safety hooks. The invention also provides a seatback mounting system that securely self locks, but unlocks easily with a simple positive action by the user to release the back system from the wheelchair. In a preferred embodiment, the seatback can be conveniently released from its mountings by a simple forward rotational motion through a prescribed angle in conjunction with a lifting action.

Because of the high level of adjustibility inherent in a preferred embodiment, the invention permits a user to quickly modify the seatback tilt, anterior-posterior location, and height while the user is seated in the back system. Moreover, once established, the seatback position is maintained regardless of removal and reinstallation onto a wheelchair.

Further attributes of the invention include a high level of adaptability for use with various wheelchairs, vibration resistance, lightweight, modular design, and safety.

The seatback system comprises, in part, a rigid shell seatback having mounted thereto a first pair of laterally extending pin assemblies and a second pair of laterally extending pin assemblies where each pin assembly has an extending pin portion. The system also comprises a first pair of mounting clips and a second pair of mounting clips. The first pair of mounting clips selectively retains the first pair of pins while the second pair of mounting clips temporarily retains the second pair of pins so long as the first pair of extending pins is secured by the first pair of mounting clips. Alternatively, the second pair of mounting clips can be generally identical to the first pair of mounting clips, although ease of use of the invention may be compromised since user manipulation of the second pair of mounting clips would be necessary in addition to the first pair.

In a preferred embodiment, each laterally extending pin assembly comprises a pin bar having a bar and an orthogonally attached pin, as well as an "L" bracket wherein the "L" bracket is adjustably mounted (laterally) to the rigid shell seatback so that the invention can be used in conjunction with various wheelchair post spacings. Moreover, the pin bar is translationally mounted to the "L" bracket so that the anterior-posterior location of the seatback can be easily modified. Because a preferred embodiment uses asymmetrical pin bars (the pin is located at one end of the bar), it is further possible to reverse the orientation of the pin bar on the "L" bracket to further increase the adjustability of the seatback position.

The first pair of mounting clips are preferably self-locking and manually releasing, and are mounted to an upper portion of the wheelchair's vertical posts or canes. The second pair of mounting clips are preferably "U" shaped members mounted to a lower portion of a wheelchair's vertical posts or canes wherein the web portion of the "U" receives the pin. Alternatively, the location of the first pair and second pair of clips can be reversed without adverse effect to the operation of the invention. Moreover, an alternative arrangement reverses the mounting locations of the laterally extending pins and the mounting clips: the pins can be mounted either fixedly or adjustably to the posts or canes while the mounting clips (of either disclosed variety) can be mounted either fixedly or adjustably to the seatback.

A preferred embodiment also includes a cushion removably attached to the rigid shell seatback wherein the cushion preferably is of the self-inflating type and resides in a cover having one part of a two part mounting means affixed thereto. By affixing a second part of a two part mounting means to the rigid shell seatback, positive location and retention of the cushion to the seatback can be achieved.

BRIEF DESCRIPTION OF THE DRAWINGS

FIG. 1 is an exploded perspective view of the seatback system of the present invention;

FIG. 2 is a front elevation view of the shell that comprises a part of the seatback system;

FIG. 3 is a front elevation view of the cushion assembly wherein the cover is shown in partial cut-away;

FIG. 4 is a cross section view taken substantially along the line 4—4 of FIG. 3 showing the relationship between the cushion core, bonded cover, and breathable outer cover;

FIG. 8 is a diagramatic matrix illustrating the various seatback configurations that are possible when manipulating the pin bar assembly on the "L" bracket;

FIG. 9 is a perspective view, in partial section, of the upper and lower mounting clips installed on a wheelchair post;

FIG. 10 is a cross section elevation of the upper mounting clip shown installed on a wheelchair post and in an "open" position;

FIG. 11 is similar to FIG. 10, except that the clip is shown in a "closed" position;

DETAILED DESCRIPTION OF THE INVENTION

Figure 5:
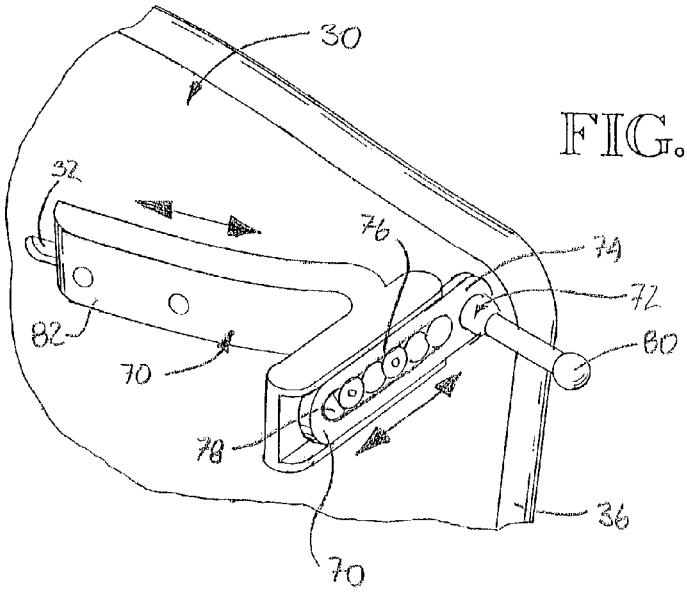
FIG. 5 is a partial perspective view illustrating the "L" bracket of the seatback system.
Figure 7:
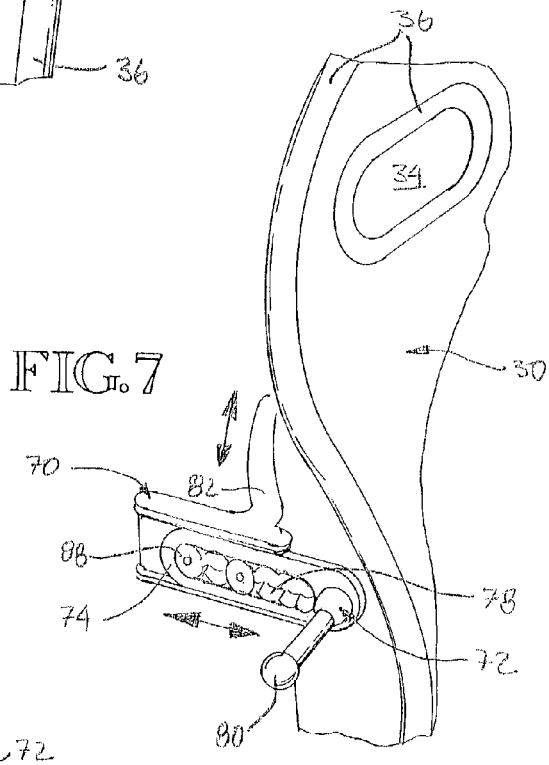
FIG. 7 is a partial perspective view illustrating the "L" bracket of the seatback system from a different perspective.
Figure 6:
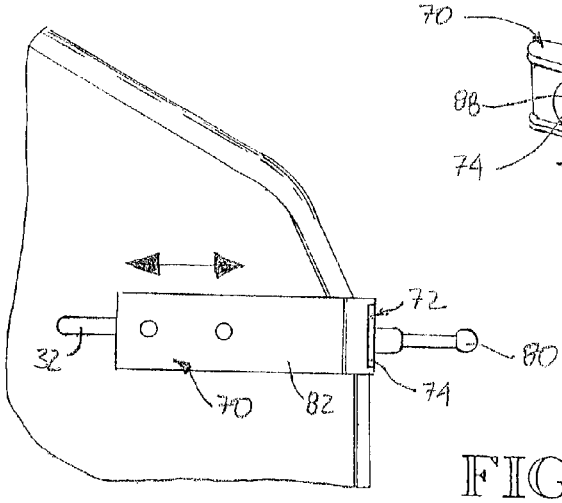
FIG. 6 is a partial perspective view illustrating the "L" bracket of the seatback system from a different perspective.

Referring then to the several Figures wherein like numerals indicate like parts, and more particularly to FIGS. 1, 2 and 5, the general components of the invention are shown. Seatback system 20 is intended to be mounted to a conventional wheelchair having a pair of vertical posts or canes 24*a* and 24*b*. Seatback system 20 comprises shell 30 to which are mounted L-brackets with pin bar assemblies 70*a*, 70*b*, 70*c*, and 70*d* (generally referred to as pin bar assemblies 70 unless otherwise indicated, as each assembly consists of identical components); upper mounting clips 90*a* and 90*b*; lower clips 140*c* and 140*d*; and cushion assembly 50. All structural components are preferably manufactured from lightweight metals such as aluminum or alloys such as aluminum-magnesium, or high strength polymers such as acrylic-butadiene-styrene (ABS) resin. The composition of cushion assembly 50 will be described in detail below.

Beginning first with shell 30, it is preferably a hard rigid matrix, which extends between wheelchair posts 24*a* and 24*b*, and provides mechanical support for seatback system 20. In the preferred embodiment, shell 30 is formed from an aluminum alloy having a sectional thickness of about 50 to 100 mils. The overall width of shell 30 should not extend beyond the internal minimum width of posts 24*a* and 24*b* for the size range of wheelchairs that the particular seatback size is designed. It is desirable that the maximum width of shell 30 clear the inside of posts 24*a* and 24*b* so that shell 30 may be reclined there through. The preferred embodiment has five sections across the horizontal of the part: central portion 40, first lateral portions 42*a* and 42*b*, and second lateral portions 44*a* and 44*b*. Central portion 40 may have a slight anterior concave curvature depending upon the intended application and design considerations.

First lateral portions 42*a* and 42*b* of shell 30 extend anteriorly and laterally to form an approximately 45 degree angle with central portion 40. The profile of shell 30 is designed to fit either conventional folding wheelchairs, which typically have two or three upwardly extending tubular posts, or to fit a rigid non-folding wheelchair, which differs from the folding type in that a formed tubular structure (not shown) extends between the vertical posts for added stability.

First lateral portions 42*a* and 42*b* are generally flat and provide an excellent surface to mount pin bar assemblies 70, as well as to provide support for cushion 52. Lower mounting slots 32*c* and 32*d* are punched, milled or fabricated in first lateral portions 42*a* and 42*b* of shell 30 (about 10–40% from the bottom of the shell), as best shown in FIG. 2. This distance corresponds to a level equivalent to a seated user's preferred pelvic alignment control points (posterior iliac crests). Upper mounting slots 32*a* and 32*b* are punched in first lateral portions 42*a* and 42*b* of shell 30 (about 50–80% from the bottom of the shell). This distance provides sufficient structural support and balance to seatback system 20. As will be described in more detail below, upper and lower pin bar assemblies 70 are semi-permanently, but adjustably, attached in their respective locations to shell 30 at these locations. Slots 32*a–d* allow for selected lateral placement and indexing of the pin bar assemblies along the range of the slotted holes.

Hand grip cut-out 34 is provided at the upper central portion of shell 30 to facilitate handling of seatback system 20 during removal or installation procedures. In addition, cut-out 34 provides a means whereby flap 48 of cover 62 may more securely engage shell 30 as will be described in more detail below.

Also present on the anterior surface of shell 30 are a plurality of fastening means for securely, but removably, attaching cushion assembly 50 to shell 30. In this embodiment, a two part hook and loop fastening system is used. Thus, for example, sections of self-adhesive hook material 38 are disposed on shell 30 substantially as shown in FIG. 2. As will be seen, complementary loop material is fixedly attached to the posterior portion of cushion assembly 50 whereby the position of cushion assembly 50 is relatively fixed to shell 30 upon engagement of the hook and loop sections.

Finally, potentially exposed peripheral edges of shell 30 are preferably fitted with a rubber-like polymer material piping 36 (with internal metal pieces offering reinforcement).

Cushion assembly 50, which is best illustrated in FIGS. 3 and 4, comprises self-inflating cushion 52 and cover 62. Cushion assembly 50 provides the wheelchair user increased positioning control because of the contour which partially envelopes a seated user's back. Cushion assembly 50's contour is rigidly supported by all anterior portions of shell 30 (central portion 40, first lateral portions 42*a* and 42*b*, and second lateral portions 44*a* and 44*b*), although a certain level of self-contour is inherent in cushion 52.

Cushion 52 is preferably fabricated according to the methods disclosed in U.S. Pat. No. 5,282,286, the disclosure of which is incorporated herein by reference. The height of cushion 52 may be approximately the same as shell 30, with a small extension to provide overlap of the shell perimeter. The posterior of cushion 52 has essentially the same profile as shell 30, except that it preferably extends laterally beyond second lateral portions 44*a* and 44*b* so as to minimize user contact with the shell perimeter. The anterior face of cushion 52 is specifically contoured to provide a suitable level of positioning and support to a seated user. In the present embodiment, the anterior surface has several vertically spaced segments generally corresponding to the anterior portions of shell 30 that are defined in part by vertical grooves 56.

A feature of cushion 52 is that it has a pre-established curvature. This curvature approximates the curvature of shell 30 and is accomplished by creating a curved foam core blank to which the coated fabric is bonded. Moreover, while both the anterior and posterior fabric panels are of generally equal area and the two panels are bonded together at their common perimeter, the anterior fabric must occupy vertical grooves 56 of cushion 52. Consequently, when the anterior panel is bonded to the foam core, the perimeter portions thereof are urged towards a point central and above the anterior surface, thereby creating an anteriorly concave profile in cushion 52.

Cover 62 is constructed from a breathable fabric material and removably envelops cushion 52. In addition to protecting cushion 52 from the elements and user damage, cover 62 has attached thereto loop material 68, which permits location of cushion assembly 50 on shell 30. Flap 48, which also has a portion of loop material 68 thereon, is insertable from the posterior side of shell 30 through hole 34, over and above the upper perimeter portion of shell 30. It engages hook material 38 on the posterior surface of shell 30 to provided for a secure fastening means that will prevent vertical movement of cushion assembly 50 on shell 30.

On the anterior surface of cover 62 is highly breathable fabric panel 64. The location of panel 64 generally corresponds to the location of a user's back when engaging seatback system 20. Because this is a high moisture area during use, the interior surface of panel 64 has bonded thereto a reticulated foam section that provides mechanical support of cover 62 from cushion 52 while ensuring sufficient ventilation properties. Moreover, because the reticulated foam is formed from expanded polymer resin, it also operates as a flame retardant barrier, thus providing greater flame resistance to cushion 52, which preferably is constructed in major part from urethane foam, a flammable material.

Turning now to FIGS. 1, 2 and 5–10, the wheelchair engaging components of seatback system 20 will now be presented. As previously described, shell 30 has four slots 32*a–d* formed therein for receiving pin bar assemblies 70. Pin bar assemblies 70 each comprise pin bars 72 and "L" bracket 82. While all pin bars 72 and brackets 82 are identical to each other, each pin bar assembly 70 is arranged to have a mirror image of each other viz a viz the sagittal plane with assembled on shell 30. Screws 84 and collar nuts 86 function to secure each bracket 82 to shell 30, and screws 88 function to secure each pin bar 72 to bracket 82. Brackets 82 function to permit lateral adjustment of pin bars 72 to accommodate variations in the distance between posts 24*a* and 24*b*, while slot 76 of each pin bar 72 functions to permit anterior-posterior adjustment of shell 30 relative to the wheelchair as shown in FIGS. 5–8. Moreover, by rotating any pin bar 72 180°, further shell adjustment can be achieved as again specifically shown in FIG. 8. Detents 78 in each slot 76 function to positively index a position of pin bar 72 relative to bracket 82 so that symmetry between each pin bar assembly pair and/or between pairs is easily maintained. In all instances, screws 84 and 88 include a thread locking device or compound to resist unintentional disengagement due to vibration and the like.

Each pin bar 72 as previously described has bar portion 74 and extending pin portion 80. Bar portion defines slot 76 and pin portion 80 extends orthogonally from bar portion 74. Because pin portion 80 is located at one end of bar portion 74, inherent asymmetry permits a great latitude of mounting possibilities on bracket 82 as best shown again in FIG. 8.

Pin portion 80 is sized to fit within the confines of either mounting clip 90 or mounting clip 140. As illustrated in FIGS. 9,10 and 11, mounting clip 90 includes vertical post clamp portion 92, bracket portion 94, rotatable cam body 102, and pawl 116. Other components include spring 132, retainer 100, ball extension 130, and shafts 134. Cam body 102 defines major recess 106, minor recess 108, groove 110, and includes peripheral surface 112 as well as portion 114. Pawl 116 has exposed portion 118, fork portion 120, which includes a fork-like structure having major finger 122 and minor finger 124, spring locator 128, and ball extension 130.

Mounting clip 90 functions to releasably hold pin portion 80 therein when inserted into slot 98 of bracket portion 94 and major recess 106 of cam body 102 as is best shown in FIG. 10. Prior to insertion, major finger 122 rests in groove 110. The light pressure created by spring 132 on pawl 116 prevents unintended rotation of cam 102 due to the position of major finger 132. Upon insertion of pin bar 72 into slot 98 and major recess 106, cam body 102 rotates until major finger 122 engages minor recess 108 of cam body 102. Spring 132 again operates to create light pressure of fork portion 120 on cam body 102, thereby preventing rotation of cam body 102. Upon pressing exposed portion 118 of pawl 116 towards post 24, major finger 122 disengages from minor recess 108.

So as to eliminate constant user pressure on exposed portion 118 to overcome the extension bias of spring 132, ball extension 130 engages receiver 100 when exposed portion 118 is fully depressed (not shown). However, this state is not conducive to permitting major finger 122 to locate in groove 110. Therefore, when cycling from the engaged state shown in FIG. 11 to the receiving state shown in FIG. 10, extension 114 of cam body 102 momentarily contacts minor finger 124. This causes dislocation of ball extension 130 from receiver 100 at a point during cam rotation that is after dislocation of major finger 122 from minor recess 108. From that point until the completion of pin removal, major finger 122 rides peripheral surface 112 until locating in groove 110 (see FIG. 10).

Figure 12:
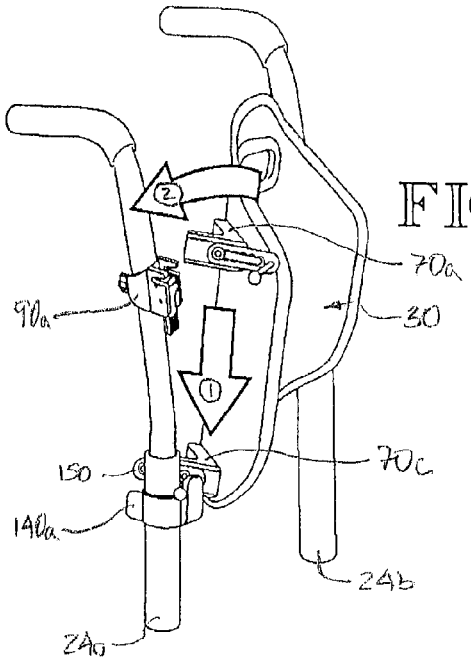
FIG. 12 is a perspective view of the seatback system as the seatback is being installed onto a wheelchair equipped with upper and lower mounting clips.
Figure 13:
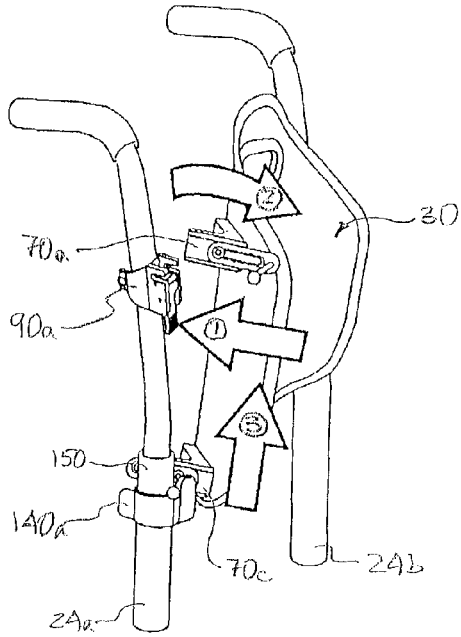
FIG. 13 is a perspective view of the seatback system as the seatback is being removed from a wheelchair equipped with upper and lower mounting clips.

In contrast to the active engagement of mounting clip 90, mounting clip 140 functions to provide a captive perch for pin portion 80, as best shown in FIGS. 12 and 13. Pin portion 80 is restrained from anterior and posterior movement by way of post 24 and extension 46, and is restrained from downward movement by recess 148. Upward movement of pin portion 80 is restrained only when pin bar 72 is positively retained in mounting clip 90. Otherwise, as illustrated in FIGS. 12 and 13, a pin bar assembly is free to move upwardly and thus release shell 30 from the wheelchair.

Figure 14:
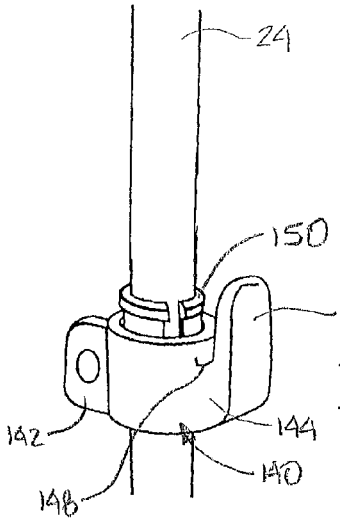
FIG. 14 is a perspective view of a mounting clip and resilient shim being installed on a post having a diameter less than the nominal diameter less than that of the mounting clip.

In order to accommodate the attachment of mounting clips 90 and 140 to posts of varying diameters, shims 150 are provided. Referencing FIG. 14, each shim 150 is preferably formed from a compliant polymer resin material, and is insertable between clamp portion 92 or 142 and a post 24. Either with or without shims 150, each mounting clip 90 and 140 is compressively retained to a post. A thread locking device or compound is preferably used so as to prevent unintentional loosening of a mounting clip.

What is claimed:

1. A wheelchair seatback system for mounting a seatback to a pair of spaced apart posts or canes of a wheelchair back frame, comprising:

a seatback comprising a first pair of laterally spaced and opposed mounting locations and a second pair of laterally spaced and opposed mounting locations longitudinally spaced from the first pair of opposed mounting locations;

a first pair of laterally extending pins attached to the first pair of opposed mounting locations on the seatback;

a second pair of laterally extending pins attached to the second pair of opposed mounting locations on the seatback;

a first pair of mounting clips respectively attached to each cane and positioned to receive the first pair of extending pins; and a second pair of mounting clips respectively attached to each cane and positioned to receive the second pair of extending pins wherein one of the first pair or the second pair of mounting clips include a pair of releasable self-locking mechanisms for retaining a pair of extending pins and releasing the same upon user activation of the mechanism.

2. The system of claim 1 wherein each self-locking mechanism comprises a bracket portion housing a rotatable cam body and retaining a pawl, and wherein the cam body defines a major recess for selectively receiving an extending pin.

3. The system of claim 2 wherein the bracket portion comprises a base joining two sides, each side having a first end, a second end, an interior surface and an exterior surface, and each side defining opposed slots for receiving a pin, and wherein the rotatable cam body and retaining pawl are each supported by the two sides of the bracket using a shaft.

4. The system of claim 2 wherein the retaining pawl comprises a major finger at one end and an arm at an opposite end, and wherein the cam body further defines a minor recess for selectively receiving the major finger.

5. The system of claim 4 wherein the bracket portion comprises a base joining two sides, each side having a first end, a second end, an interior surface and an exterior surface, and each side defining opposed slots for receiving a pin, and wherein the rotatable cam body and retaining pawl are each supported by the two sides using a shaft, and the releasable self-locking mechanism further comprises a biasing element having a first end and a second end wherein the first end contacts the bracket base and the second end contacts the pawl.

6. The system of claim 4 wherein the retaining pawl further comprises a ball extension and the bracket further comprises a receiver to releasably receive the ball extension.

7. The system of claim 4 wherein the retaining pawl further comprises a minor finger spaced apart from the major finger at the one end, and the cam body further defines a groove for selectively receiving the minor finger.

8. The system of claim 1 wherein at least one of the first or second pair of laterally extending pins comprises a pair of pin bars, each pin bar having a bar portion defining at least one opening, and wherein the extending pin is substantially orthogonally located on the bar portion.

9. The system of claim 8 wherein the extending pin is positioned at one end of the bar portion.

10. The system of claim 8 wherein the at least one opening is one of a slot or a circular hole.

11. The system of claim 1 further comprising a pair of angle brackets directly connected to at least one of the first or second pair of laterally spaced and opposed mounting locations to provide a means by which the pins are connected to the seatback.

12. The system of claim 11 wherein each angle bracket comprises a first leg and a second leg, the first leg having means for engaging the seatback and the second leg having means for engaging a pin bar comprising a bar portion defining at least one opening and an extending pin substantially orthogonally located on the bar portion, wherein one of the seatback or the first leg defines a slot and one of the pin bar or the second leg defines a slot.

13. The system of claim 1 further comprising a cushion removably associated with the seatback, the cushion comprising a flexible, fluid impervious envelope defining a sealed chamber and enclosing a resilient element; and a valve sealingly engaged with the envelope to modulate fluid flow into and out of the chamber.

14. The system of claim 13 wherein the resilient element is bonded to an inner surface of the envelope.

15. A removable seatback system, with user determinable anterior and posterior positioning, for mounting to a pair of spaced apart support members comprising:

a seatback comprising a pair of superior mounting locations and a pair of inferior mounting locations wherein one pair of the superior or inferior mounting locations has attached thereto a first connecting means for linking the seatback system to the support members comprising one of a pair of extending pins capable of anterior and posterior movement or a pair of pin receiving members; and a second connecting means for linking the seatback system to the support members comprising one of a pair of extending pins capable of anterior and posterior movement or a pair of pin receiving members positioned on the support members to receive the first connecting means wherein each said pin receiving member comprises a releasable self-locking mechanism for selectively receiving and retaining an extending pin and releasing the same upon user activation of the mechanism.

16. The system of claim 15 wherein the pin receiving members each comprise a bracket portion housing a rotatable cam body and retaining a pawl, and wherein the cam body defines a major recess for selectively receiving an extending pin.

17. The system of claim 16 wherein the bracket portion comprises a base joining two sides, each side having a first end, a second end, an interior surface and an exterior surface, and each side defining opposed slots for receiving a pin, and wherein the rotatable cam body and retaining pawl are each supported by the two sides of the bracket using a shaft.

18. The system of claim 16 wherein the retaining pawl comprises a major finger at one end and an arm at an opposite end, and wherein the cam body further defines a minor recess for selectively receiving the major finger.

19. The system of claim 18 wherein the bracket portion comprises a base joining two sides, each side having a first end, a second end, an interior surface and an exterior surface, and each side defining opposed slots for receiving a pin, and wherein the rotatable cam body and retaining pawl are each supported by the two sides using a shaft, and the releasable self-locking mechanism further comprises a biasing element having a first end and a second end wherein the first end contacts the bracket base and the second end contacts the pawl.

20. The system of claim 18 wherein the retaining pawl further comprises a ball extension and the bracket further comprises a receiver to releasably receive the ball extension.

21. The system of claim 18 wherein the retaining pawl further comprises a minor finger spaced apart from the major finger at the one end, and the cam body further defines a groove for selectively receiving the minor finger.

22. The system of claim 15 wherein a pin bar comprises the extending pin, each pin bar having a bar portion defining at least one opening, and wherein the extending pin is substantially orthogonally located on the bar portion.

23. The system of claim 22 wherein the extending pin is positioned at one end of the bar portion.

24. The system of claim 22 wherein the at least one opening is one of a slot or a circular hole.

25. The system of claim 15 further comprising a pair of angle brackets directly connected to one pair of the superior or inferior mounting locations.

26. The system of claim 25 wherein each angle bracket comprises a first leg and a second leg, the first leg having means for engaging the seatback and the second leg having means for engaging a pin bar comprising a bar portion defining at least one opening and the extending pin substantially orthogonally located on the bar portion, wherein one of the seatback or the first leg defines a slot and one of the pin bar or the second leg defines a slot.

27. The system of claim 15 further comprising a cushion removably associated with the seatback, the cushion comprising a flexible, fluid impervious envelope defining a sealed chamber and enclosing a resilient element; and a valve sealingly engaged with the envelope to modulate fluid flow into and out of the chamber.

28. The system of claim 27 wherein the resilient element is bonded to an inner surface of the envelope.

29. A method for removing and inserting a seatback from a pair of support elements, the seatback comprising a pair of superior lateral mounting locations, each having a pin bar comprising a bar portion and an extending pin, and a pair of inferior lateral mounting locations, each having a pin bar comprising a bar portion and an extending pin, wherein each extending pin is receivable by a receiving member mountable to a pair of substantially upright support elements disposed on opposite lateral sides of the seatback when engaged therewith, the method comprising:

disengaging the seatback from the support elements by manual operation a pair of releasable self-locking mechanism located on the substantially upright support elements so as to permit exposure and removal of the pin bars there from, and condition the mechanism to subsequently and passively receive the pin bars;

translating the seatback in one of a posterior or anterior direction such that the formerly captive pin bars can be removed from the releasable self-locking mechanisms; and engaging the seatback with the support elements by positioning the pin bars in the releasable self-locking mechanisms and translating the seatback in one of a posterior or anterior direction to secure the seatback to the upright support elements.

30. The method of claim 29 wherein the the pin bars are partially engaged with the mechanism prior to securing the seatback.

* * * * *